US005941455A

United States Patent [19]

Cutugno

[11] Patent Number: 5,941,455

[45] Date of Patent: Aug. 24, 1999

[54] SWIVELING MAIL BOX STAND

[76] Inventor: Johnny L. Cutugno, 335 Eden Rd., Quarryville, Pa. 17566

[21] Appl. No.: 09/164,644

[22] Filed: Oct. 1, 1998

[51] Int. Cl.[6] ..... B65D 91/00

[52] U.S. Cl. ..... 232/39; 232/17; 248/131; 248/145; 248/418

[58] Field of Search ..... 232/17, 45, 39, 232/29, 1 C; D99/32; 248/131, 145, 415, 418

[56] References Cited

U.S. PATENT DOCUMENTS

| | | | |
|---|---|---|---|
| 935,715 | 10/1909 | Watson . | |
| 1,508,052 | 9/1924 | Hastings . | |
| 1,584,085 | 5/1926 | England . | |
| 1,994,186 | 3/1935 | Anderson | 232/39 |
| 3,229,940 | 1/1966 | Kagels . | |
| 3,497,078 | 2/1970 | Nash . | |
| 3,802,656 | 4/1974 | Virblas . | |
| 3,870,262 | 3/1975 | Manning, Jr. | 232/39 X |
| 3,999,702 | 12/1976 | Conroy | 232/39 |
| 4,113,213 | 9/1978 | Gay et al. | 232/39 X |
| 4,146,171 | 3/1979 | Hodge | 232/39 X |
| 4,187,978 | 2/1980 | Dowker | 232/39 |
| 4,955,533 | 9/1990 | Merkel | 232/39 |
| 5,215,283 | 6/1993 | Gould . | |
| 5,411,206 | 5/1995 | Latham et al. . | |
| 5,445,086 | 8/1995 | Bolduc . | |
| 5,713,514 | 2/1998 | Eck | 232/39 |

*Primary Examiner*—Brian K. Green
*Assistant Examiner*—William L. Miller

[57] ABSTRACT

A mailbox stand is provided including a vertical post with a bottom end mounted within a shoulder of a road. Also included is a horizontal rod mounted on the vertical post and adapted to rotate about a vertical axis. Next provided is a mail box mounted on an outboard end of the horizontal rod.

9 Claims, 4 Drawing Sheets

SWIVELING MAIL BOX STAND

BACKGROUND OF THE INVENTION

1. Field of the Invention

The present invention relates to mail box stands and more particularly pertains to a new swiveling mail box stand for allowing the use of a mail box during winters where snow is prevalent and snow plowing is necessary.

2. Description of the Prior Art

The use of mail box stands is known in the prior art. More specifically, mail box stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art mail box stands include U.S. Pat. No. 5,215,283; U.S. Pat. No. 5,445,086; U.S. Pat. No. 5,411,206; U.S. Pat. No. 5,437,409; U.S. Pat. No. 5,042,716; and U.S. Pat. No. Des. 338,765.

In these respects, the swiveling mail box stand according to the present invention substantially departs from the conventional concepts and designs of the prior art, and in so doing provides an apparatus primarily developed for the purpose of allowing the use of a mail box during winters where snow is prevalent.

SUMMARY OF THE INVENTION

In view of the foregoing disadvantages inherent in the known types of mail box stands now present in the prior art, the present invention provides a new swiveling mail box stand construction wherein the same can be utilized for allowing the use of a mail box during winters where snow is prevalent.

The general purpose of the present invention, which will be described subsequently in greater detail, is to provide a new swiveling mail box stand apparatus and method which has many of the advantages of the mail box stands mentioned heretofore and many novel features that result in a new swiveling mail box stand which is not anticipated, rendered obvious, suggested, or even implied by any of the prior art mail box stands, either alone or in any combination thereof.

To attain this, the present invention generally comprises a vertical post having a cylindrical configuration with a bottom end mounted within a shoulder of a road. An outer surface of the vertical post has a thin groove formed therein adjacent to the top end. As shown in FIG. 7, the thin groove extends along ½ a circumference of the outer surface and remains in concentric relationship with the post. Next provided is a connector tube including a vertical portion adapted to rotatably receive the top end of the vertical post. The vertical portion has a threaded aperture formed therein for receiving a set screw screwably mounted therein. The set screw extends within the thin groove of the vertical post for allowing the rotation of the connector tube about 180 degrees. Note FIGS. 7 & 8. The connector tube further includes a horizontal portion coupled at a central extent thereof to a top of the vertical portion in perpendicular relationship therewith. The horizontal portion resides about an axis which remains perpendicular with an axis about which the set screw is formed. For reasons that will become apparent hereinafter, an interior surface of the horizontal portion has a guide tab formed in a lower extent thereof, as shown in FIG. 6. Slidably situated within the horizontal portion of the connector tube is a horizontal rod. The horizontal rod has an inboard end with a cap formed thereon. An outer surface of the horizontal rod is equipped with a linear groove formed therein in parallel with an axis of the horizontal rod. The linear groove is adapted for receiving the guide tab of the connector tube. Finally, a mailbox mount includes a horizontally oriented rectangular plate. Coupled to a lower surface of the rectangular plate is a plurality of triangular planar supports. As shown in FIG. 2, a mounting tube is coupled below the plate and situated perpendicularly through the supports. The mounting tube serves for receiving an outboard end of the horizontal rod. A top surface of the plate has a plurality of side-by-side flanges each having a rectangular configuration and extending upwardly from the plate. Each flange defines a protrusion adapted for receiving a lower portion of a mailbox.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new swiveling mail box stand apparatus and method which has many of the advantages of the mail box stands mentioned heretofore and many novel features that result in a new swiveling mail box stand which is not anticipated, rendered obvious, suggested, or even implied by any of the prior art mail box stands, either alone or in any combination thereof.

It is another object of the present invention to provide a new swiveling mail box stand which may be easily and efficiently manufactured and marketed.

It is a further object of the present invention to provide a new swiveling mail box stand which is of a durable and reliable construction.

An even further object of the present invention is to provide a new swiveling mail box stand which is susceptible of a low cost of manufacture with regard to both materials and labor, and which accordingly is then susceptible of low prices of sale to the consuming public, thereby making such swiveling mail box stand economically available to the buying public.

Still yet another object of the present invention is to provide a new swiveling mail box stand which provides in the apparatuses and methods of the prior art some of the advantages thereof, while simultaneously overcoming some of the disadvantages normally associated therewith.

Still another object of the present invention is to provide a new swiveling mail box stand for allowing the use of a mail box during winters where snow is prevalent.

Even still another object of the present invention is to provide a new swiveling mail box stand that includes a vertical post with a bottom end mounted within a shoulder of a road. Also included is a horizontal rod mounted on the vertical post and adapted to rotate about a vertical axis. Next provided is a mail box mounted on an outboard end of the horizontal rod.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
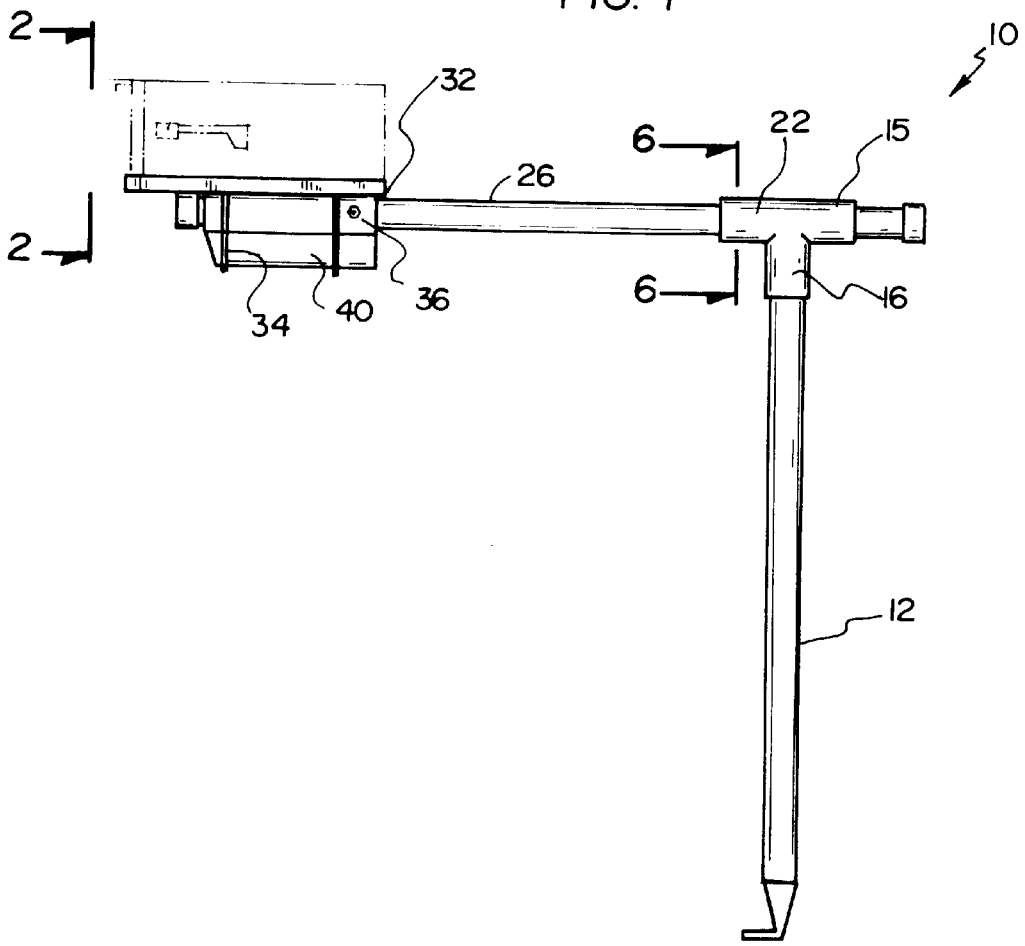
FIG. 1 is a side view of a new swiveling mail box stand according to the present invention.

With reference now to the drawings, and in particular to FIGS. 1 through 8 thereof, a new swiveling mail box stand embodying the principles and concepts of the present invention and generally designated by the reference numeral 10 will be described.

Figure 7:
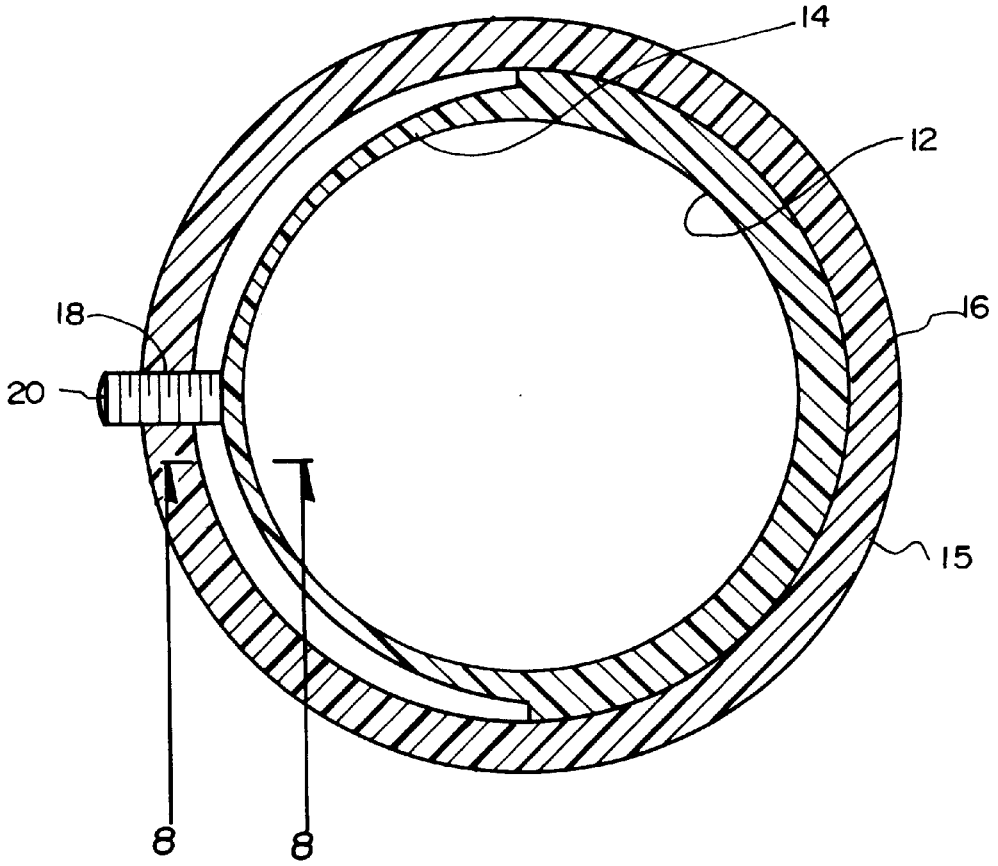
FIG. 7 is a cross-sectional view of the present invention taken along line 7—7 shown in FIG. 6 showing the interconnection of the connector tube and vertical post.
Figure 8:
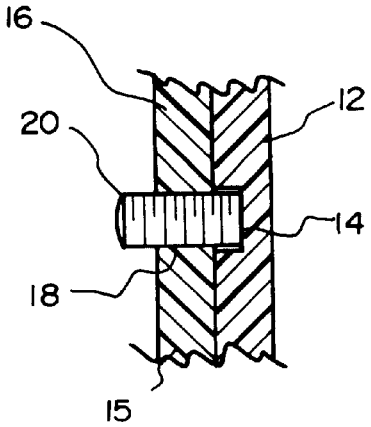
FIG. 8 is a cross-sectional view of the present invention taken along line 8—8 shown in FIG. 7 showing the interconnection of the connector tube and horizontal rod.

The present invention, designated as numeral 10, includes a vertical post 12 having a cylindrical configuration with a bottom end mounted within a shoulder of a road. An outer surface of the vertical post has a thin groove 14 formed therein adjacent to the top end. As shown in FIG. 7, the thin groove extends along ½ a circumference of the outer surface and remains in concentric relationship with the post. It should be noted that the depth of the thin groove preferably lessens adjacent to ends thereof for reasons that will soon become apparent hereinafter.

Next provided is a connector tube 15 including a vertical portion 16 adapted to rotatably receive the top end of the vertical post. The vertical portion has a threaded aperture 18 formed therein for receiving a set screw 20 screwably mounted therein. The set screw extends within the thin groove of the vertical post for allowing the rotation of the connector tube about 180 degrees. Note FIGS. 7 & 8.

Figure 6:
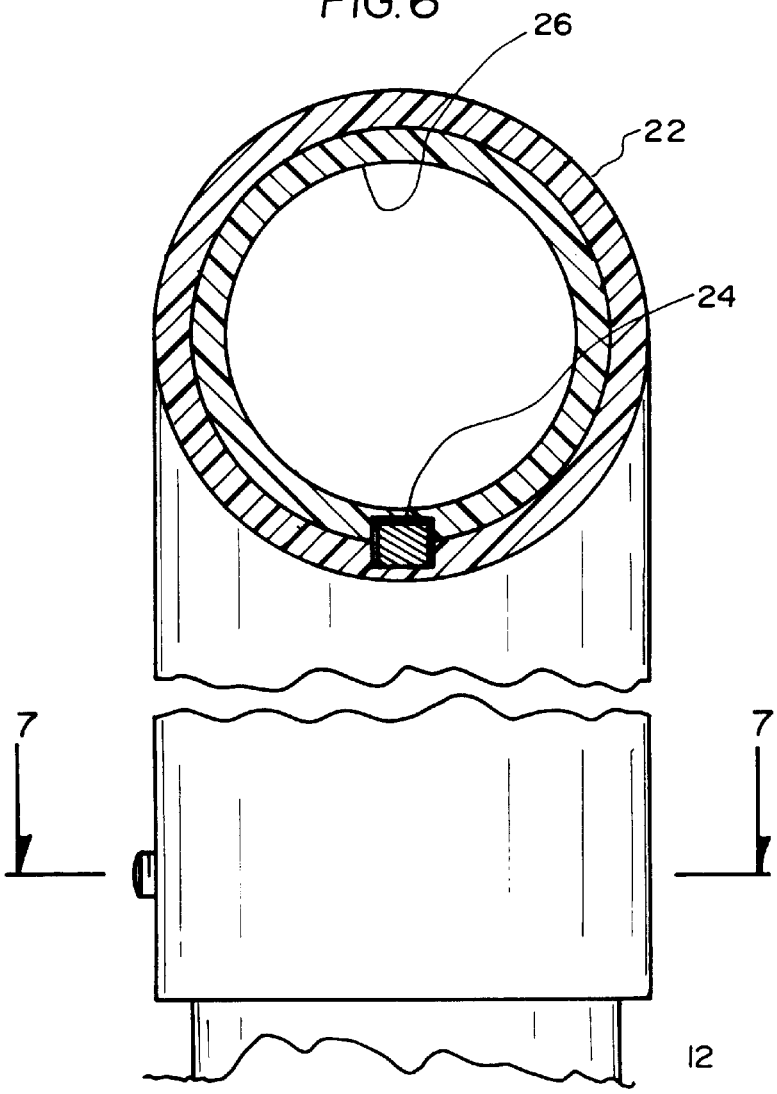
FIG. 6 is a cross-sectional view of the present invention taken along line 6—6 shown in FIG. 1 showing the interconnection of the connector tube and horizontal rod.

The connector tube further includes a horizontal portion 22 coupled at a central extent thereof to a top of the vertical portion in perpendicular relationship therewith. For reasons that will become apparent hereinafter, an interior surface of the horizontal portion has a guide tab 24 formed in a lower extent thereof, as shown in FIG. 6. In the preferred embodiment, the horizontal and vertical portions of the connector tube each have a length which is less than ¼ that of the vertical post.

Slidably situated within the horizontal portion of the connector tube is a horizontal rod 26 with a length approximately equal to that of the vertical post. It should be noted that the vertical post, horizontal rod, and connector tube each are constructed from PVC. Both ends of the rod have an enlarged cap formed thereon. An outer surface of the horizontal rod is equipped with a linear groove 30 formed therein in parallel with an axis of the horizontal rod. The linear groove is adapted for receiving the guide tab of the connector tube. As such, rotation of the horizontal rod about a horizontal axis is precluded.

Figure 2:
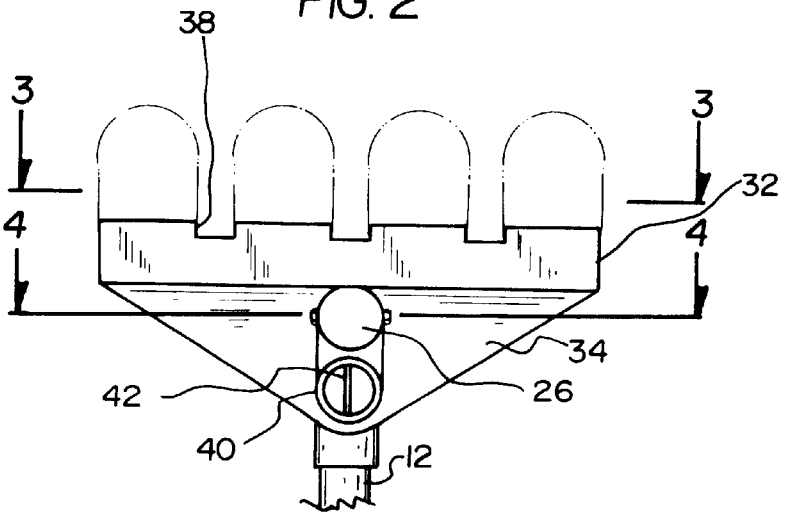
FIG. 2 is a front view of the present invention.
Figure 3:
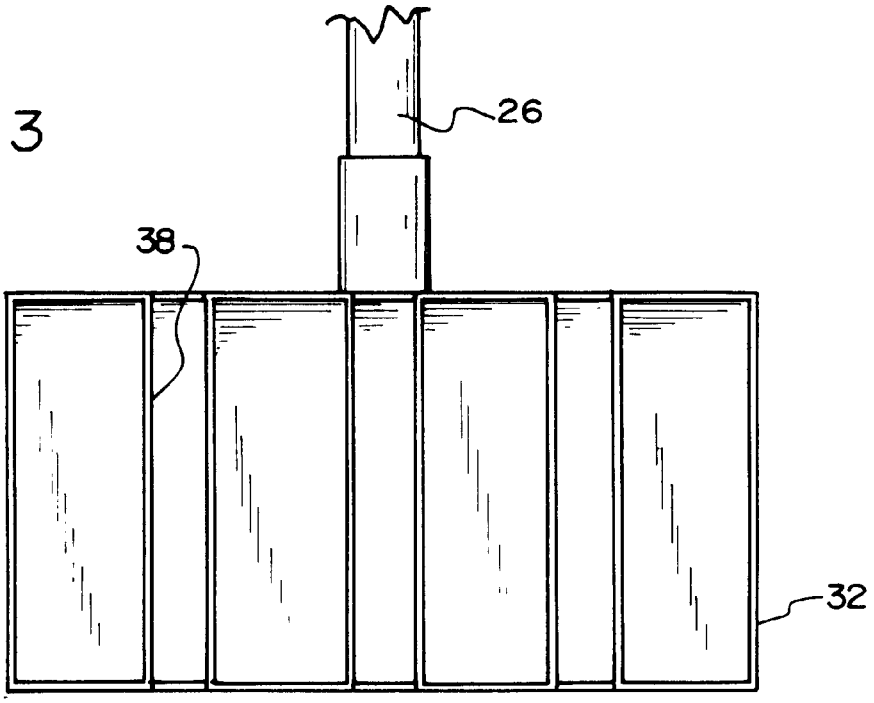
FIG. 3 is a top view of the mailbox mount of the present invention.
Figure 4:
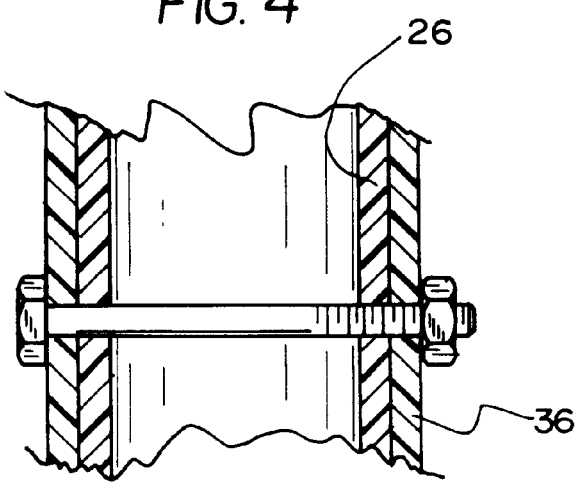
FIG. 4 is a cross-sectional view of the present invention taken along line 4—4 shown in FIG. 2.
Figure 5:
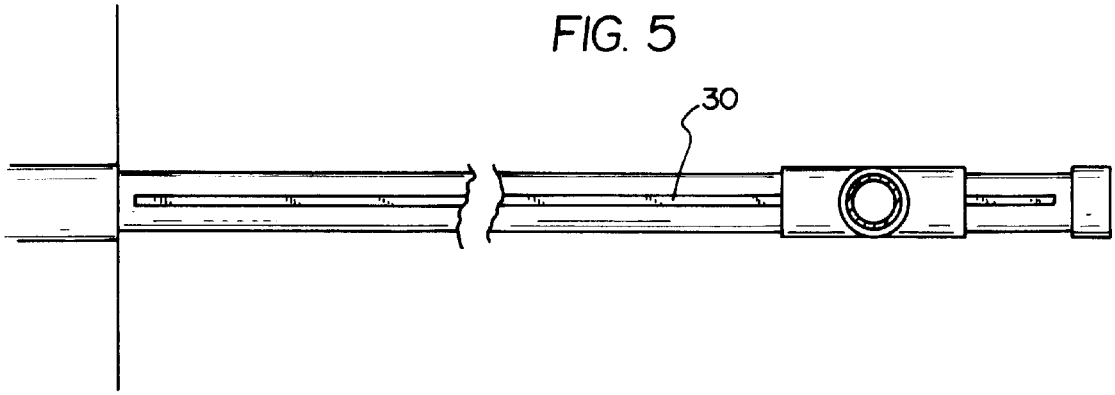
FIG. 5 is a bottom view of the horizontal rod of the present invention.

Finally, a mailbox mount 32 includes a horizontally oriented rectangular plate. Coupled to a lower surface of the rectangular plate is a plurality of triangular planar supports 34. As shown in FIG. 2, a mounting tube 36 is coupled below the plate and situated perpendicularly through the supports. The mounting tube serves for receiving an outboard end of the horizontal rod. A top surface of the plate has a plurality of side-by-side flanges 38 each having a rectangular configuration and extending upwardly from the plate. Each flange defines a protrusion adapted for receiving a lower portion of a mailbox. Preferably, the flanges are configured such that different configurations of various numbers of mailboxes may be used. Further, an auxiliary tube 40 with a back stop 42 is mounted below the mounting tube in parallel relationship therewith for temporarily housing various periodicals and the like.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mailbox stand comprising:

a vertical post having a cylindrical configuration with a bottom end adapted for mounting in a ground surface, a top end and an outer surface formed therebetween, the outer surface having a thin groove formed therein adjacent to the top end, the thin groove extending along ½ a circumference of the outer surface and in concentric relationship with the post;

a connector tube including a vertical portion adapted to rotatably receive the top end of the vertical post, the vertical portion having a threaded aperture formed therein for receiving a set screw screwably mounted therein with the set screw extending within the thin groove of the vertical post for allowing the rotation of the connector tube about 180 degrees, the connector tube further including a horizontal portion coupled at a central extent thereof to a top of the vertical portion in perpendicular relationship therewith, the horizontal portion being formed about an axis which remains perpendicular with an axis about which the set screw is formed, wherein an interior surface of the horizontal portion has a guide tab formed in a lower extent thereof; and a horizontal rod being slidably situated within the horizontal portion of the connector tube, the horizontal rod having an inboard end with a cap formed thereon and an outer surface of the horizontal rod with a linear groove formed therein in parallel with an axis of the horizontal rod for receiving the guide tab of the connector tube; and a mailbox mount including a horizontally oriented rectangular plate, a plurality of triangular planar supports coupled to a lower surface of the rectangular plate and depending therefrom in perpendicular relationship therewith, a mounting tube coupled below the plate and through the supports for receiving an outboard end of the horizontal rod, wherein a top surface of the plate has a plurality of side-by-side flanges each having a rectangular configuration and extending upwardly from the plate each for receiving a lower portion of a mailbox.

2. A mailbox system comprising:

a vertical post having a bottom end adapted for mounting in a ground surface, and an outer surface;

a connector tube including a vertical portion adapted to rotatably receive a top end of the vertical post, and a horizontal portion;

a horizontal rod mounted to the horizontal portion of the connector tube and adapted to rotate about a vertical axis;

a mail box mounted on an outboard end of the horizontal rod;

the vertical portion having a threaded aperture formed therein receiving a set screw screwably mounted therein; and the outer surface of the vertical post having a thin groove formed therein adjacent to the top end and the set screw extending into the thin groove for cooperatingly enabling limited rotation of the connector tube about a vertical axis.

3. A mailbox system as set forth in claim 2 wherein the horizontal rod is slidably situated along a horizontal axis with respect to the vertical post.

4. A mailbox system as set forth in claim 2 wherein the rotation of the horizontal rod is limited to 180 degrees.

5. A mailbox system as set forth in claim 2 wherein the rotation of the horizontal rod is limited to 180 degrees by the cooperation between the set screw and the thin groove.

6. A mailbox system as set forth in claim 2 wherein the mail box is mounted on the horizontal rod via a planar plate with at least one rectangular protrusion formed on a top face thereof for securely receiving a bottom of the mail box.

7. A mailbox system as set forth in claim 2, further comprising an auxiliary tube mounted below the horizontal rod and having a back stop.

8. A mailbox system as set forth in claim 2, wherein the horizontal and vertical portions of the connector tube each have a length which is less than about one-fourth of a length of the vertical post.

9. A mailbox system as set forth in claim 2, wherein the vertical post, horizontal rod and connector tube each comprise a polyvinyl chloride (PVC) material.

* * * * *